US011141346B2

(12) United States Patent
Callow

(10) Patent No.: US 11,141,346 B2
(45) **Date of Patent: *Oct. 12, 2021**

(54) CONTOURED DILDO AND HARNESS PLATE

(71) Applicant: Perfect Fit Brand, Inc., Boca Raton, FL (US)

(72) Inventor: Stephen Callow, Fort Lauderdale, FL (US)

(73) Assignee: Perfect Fit Brand, Inc., Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/434,329

(22) Filed: Jun. 7, 2019

(65) Prior Publication Data

US 2019/0282440 A1 Sep. 19, 2019

Related U.S. Application Data

(63) Continuation of application No. 14/670,370, filed on Mar. 26, 2015, now Pat. No. 10,314,761.

(51) Int. Cl.
*A61H 19/00* (2006.01)

(52) U.S. Cl.
CPC ..... *A61H 19/50* (2013.01); *A61H 19/32* (2013.01); *A61H 19/44* (2013.01); *A61H 2201/1628* (2013.01); *A61H 2201/1645* (2013.01); *A61H 2201/1652* (2013.01)

(58) Field of Classification Search
CPC ..... A61F 5/41; A61F 2005/411; A61F 2005/412; A61F 7/00; A61F 7/10; A61F 2007/105; A61F 2007/0048
USPC ..... 600/38–41
See application file for complete search history.

(56) References Cited

U.S. PATENT DOCUMENTS

| | | | | |
|---|---|---|---|---|
| 6,749,558 | B1 * | 6/2004 | Brintle | A61F 5/41 600/38 |
| 10,314,761 | B2 * | 6/2019 | Callow | A61H 19/44 |
| 2013/0131442 | A1 * | 5/2013 | Tomlinson, Jr. | A61F 2/78 600/38 |

* cited by examiner

*Primary Examiner* — Samuel G Gilbert
(74) *Attorney, Agent, or Firm* — Assouline & Berlowe, PA; Peter A. Koziol, Esq.

(57) ABSTRACT

A dildo and harness plate formed of a contoured member adapted to comfortably fit and secure an elongated member to the pubic region and perineal regions of a donning user while enabling comfortable access to the donning user's genitals and providing a variety of configurations for connections mounts for comfortably securing the device with straps and connectors.

20 Claims, 6 Drawing Sheets

CONTOURED DILDO AND HARNESS PLATE

A portion of the disclosure of this patent document contains material which is subject to copyright protection. The copyright owner has no objection to the facsimile reproduction by anyone of the patent document or the patent disclosure, as it appears in the United States Patent and Trademark Office patent file or records, but otherwise reserves all copyright rights whatsoever.

CROSS-REFERENCE TO RELATED APPLICATIONS

This patent application claims the benefit under 35 U.S.C. § 119(e) of U.S. Non-Provisional patent application Ser. No. 14/670,370, filed Mar. 26, 2015, which application is incorporated herein by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention broadly relates to sexual aids, more specifically to a unified dildo and bottom open anatomically contoured harness plate.

Description of the Related Art

Generally, a dildo is an object used during sexual activity for anal, vaginal, or oral stimulation. Dildos are made of a variety of materials, including but not limited to silicone, rubber, plastic, wood, glass, metal, etc., and are generally phallic and elongated in shape. Dildos incorporate design features imitative of a human penis or are shaped as other objects including artificial and natural designs that often enhance sexual stimulation. In some cases, the distal end of a dildo, the base, has a handle, clip, fastener or other means for attachment to a stationary or moving object, or to the surface of a partner's body or a machine. Many dildos incorporate various massagers, vibrators and textured surfaces, either directly or indirectly.

In use, dildos are inserted into an orifice, such as a mouth, vagina, and/or anus of a person, either by the individual user, a partner or partners, or in conjunction with a machine. Dildos provide stimulation from friction through manipulation upon sexual organs and erogenous zones and by pressure upon a cavity and surrounding organs and tissue when inserted into an orifice. Dildos are often used with natural and artificial lubrication depending on the application, use, and desired sensation by the users.

Dildos are used in a variety of circumstances. Dildos are used by two or more people to share sexual pleasure with each other, either in lieu of or in addition to other methods of sexual activity. Dildos are also used individually by either sex for masturbation, stimulation, or exhibition. In addition to their use for pleasure and entertainment, dildos are used for other purposes such as contraception, disease avoidance, disability, erectile dysfunction, temporary fatigue, medical treatment, and training.

Dildos are typically rigid, semi rigid, solid, or non-rigid and optionally include beads, liquids and gels. Some dildos provide a hollow internal shaft and an opening at the distal end adapted to receive a user's penis. Such dildos are known as extenders, extensions, penis sleeves and hollow plugs. The user, who may, for example, suffer from medical conditions including but not limited to micropenis or erectile dysfunction, may wear a penis sleeve over his penis by inserting his penis into the sleeve's opening to achieve an increased effective penis length and girth to provide increased sexual pleasure with or without a partner.

Using a user's hand to control a dildo interferes with various methods of sexual activity since it occupies the user's hand. A "strap-on" dildo, as it is commonly referred to, solves this problem by providing a means to attach the dildo to a user's body, thereby allowing hands-free manipulation of the dildo during sexual activity. A strap-on dildo commonly attaches to a harness that has one or more straps that attaches the dildo to the body of the user. The dildo portion of the strap-on is screwed into the harness, snapped on, or inserted through an opening in the harness. The harness is attached to various body parts including, but not limited to, the pelvis, elbow, knee, foot and head.

Strap-on dildos are made in a wide variety of styles, with variations in how the harness is contoured to fit the user, how the dildo attaches to the harness, as well as various features intended to provide stimulation of the user or a sexual partner of the user. In one example, a strap-on dildo is attached to the user's pelvic region, inserted into a partner's orifice, and manipulated by the user through varying pelvic thrusts.

Various types of harnesses are used with strap-on dildos. Many harnesses utilize common strap configurations that include two or more straps to hold the strap-on on the user. However, there are also forms of strapless, "strap-on" dildos that attach using strings or that plug into the user's anal and/or vaginal orifices.

For example, U.S. Pat. No. 5,690,603 (issued to "Kain") discloses an ergogenic stimulator that features a bulb at one end adapted to fit inside of a vagina or anus and serves to secure the ergogenic stimulator to the user's pubic region.

U.S. Pat. No. 6,793,620 (issued to "Droznin, et al.") discloses a strapless male sexual aid that features a hollow dildo coupled to a strap that wraps around the testicles of the user to secure the sexual aid to the user's genitalia.

U.S. patent application Ser. No. 13/673,893 (applied by "Thomlinson") criticizes these devices because they are uncomfortable, fail to accommodate a male user's testicles, and do not provide adequate support and stability.

Thomlinson's solution is a variation of a pelvic harness, including: "a tab having a first surface that is adapted to secure to at least a portion of a superior pubic skin region, the tab positioned at a first end of the pelvic harness; and a saddle having a first surface adapted to secure to at least a portion of a perineal-anal region, the saddle positioned at a second, opposite end of the pelvic harness." However, Thomlinson's harness, when used with a dildo, fails for similar reasons.

However, prior to the instant invention, many problems existed with current dildo/harness systems. Namely, current dildo/harness systems have multiple pieces that separate during use in sexual activities. Moreover, the use of multiple pieces allows for the collection of unwanted dirt and bacteria between the various pieces that is unhygienic. Plus, bodily fluids and artificial lubricants collect in joints and voids in current dildo/harness systems. Cleaning these collection areas is often quite difficult, thereby creating dirt and bacteria that are unhygienic for use in sexual activity, especially given the propensity for infections in genital regions.

Also, the design of current dildo harnesses often fail to stimulate a user's perineum, leaving the user with a desire for better control, stimulation, and massage of the perineum.

When current dildo harnesses are attached to a sexual partner's pelvic region, strap on dildo harnesses interfere and block access to the partner's genitals.

Another drawback of current dildo harnesses is that they are uncomfortable to wear and to use by a user with male genitals. The dildo harness sits on top of the male genitals, which creates uncomfortable pressure that sometimes injures the user's genitals during sexual activity and intercourse.

As can be derived from the variety of devices strap-on devices for sexual activity, many means have been contemplated to accomplish the desired end, i.e., multi-piece dildo harnesses. Heretofore, tradeoffs between comfort and cleanliness were required. Thus, there is a long-felt need for an improved strap on device for sexual activity. There is a further long-felt need for a unified dildo and bottom open anatomically contoured harness plate.

SUMMARY OF THE INVENTION

The present invention overcomes the problems with the prior art by utilizing a Unified Dildo and Bottom Open Anatomically Contoured Harness Plate. The inventor has found that by combining the harness plate and dildo into a single anatomically contoured piece has significant advantages over the prior art. In particular, the single piece is easier to manufacture, eases cleaning, and provides for improved: control, comfort, and fit.

Although the single piece could be used without harness straps, the ability to use harness straps provides for further support and prevents the dildo harness from disconnecting during sexual activity. A hole in the base of the harness plate provides and opening for comfort and access to a penis or vagina during use by male and female users.

A hollow shaft accommodates flaccid and erect male human genitals, a plug or vibrator for multiple uses by individual males, females and partners and groups engaged in heterosexual, homosexual, and bisexual activity. The harness provides additional support and stimulation of the perineum while prolonging and strengthening a male user's erection.

The dildo harness may be combined with other sexual articles, cod pieces, and jock straps pending on the application and user preference.

Although the invention is illustrated and described herein as embodied as a Unified Dildo and Bottom Open Anatomically Contoured Harness Plate, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

BRIEF DESCRIPTION OF THE DRAWINGS

Features and advantages of the present invention will become apparent to those skilled in the art from the following description with reference to the drawings.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "sexual activity" is synonymous with terms such as "oral sex", "intercourse", "foreplay", "anal sex", "masturbation", etc., and such terms may be used interchangeably as appearing in the specification and claims. Similarly, the term slot is synonymous with any type of connection mechanism, either permanent or removable. Although any methods, devices or materials similar or equivalent to those described herein can be used in the practice or testing of the invention, the preferred methods, devices, and materials are now described.

Figure 1:
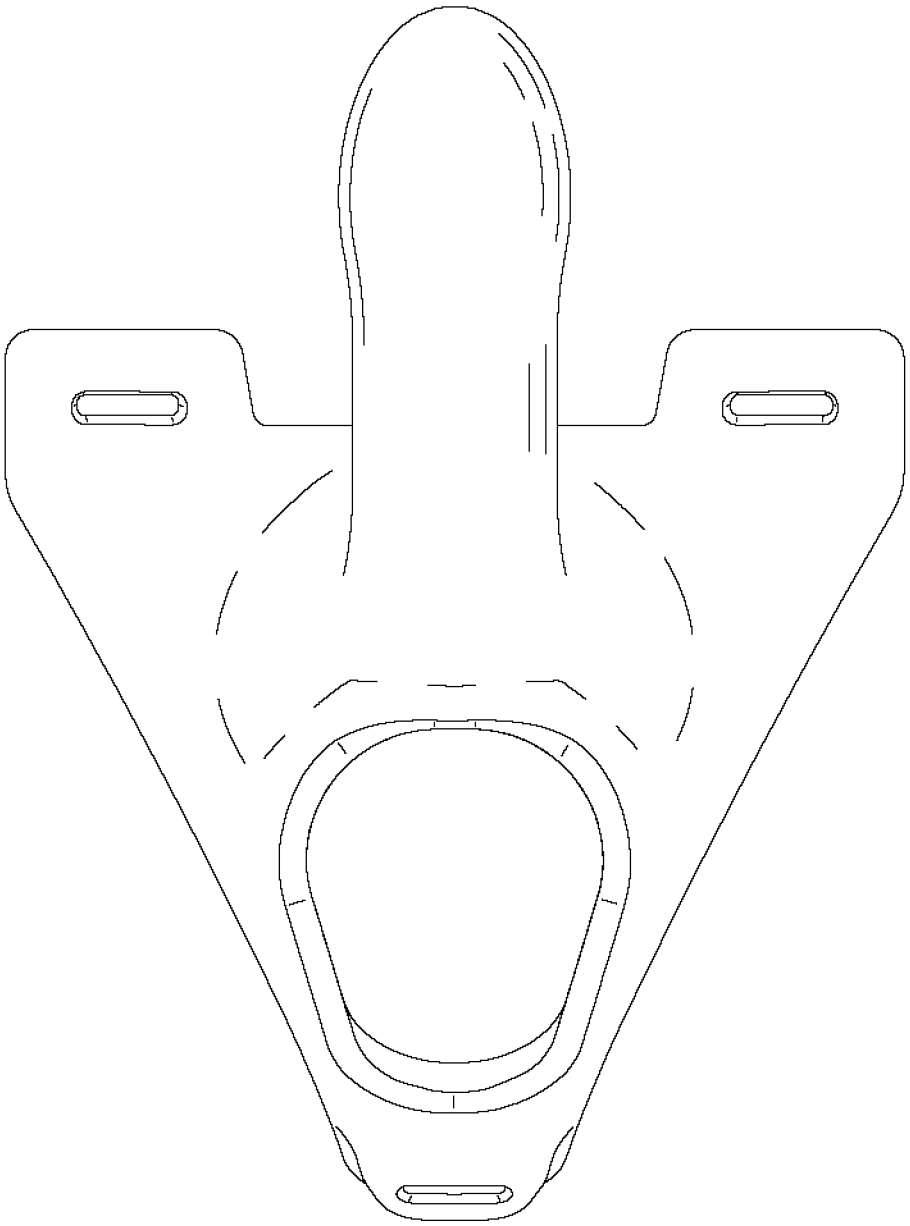
FIG. 1 depicts a front view of the Unified Dildo and Bottom Open Anatomically Contoured Harness Plate.
Figure 2:
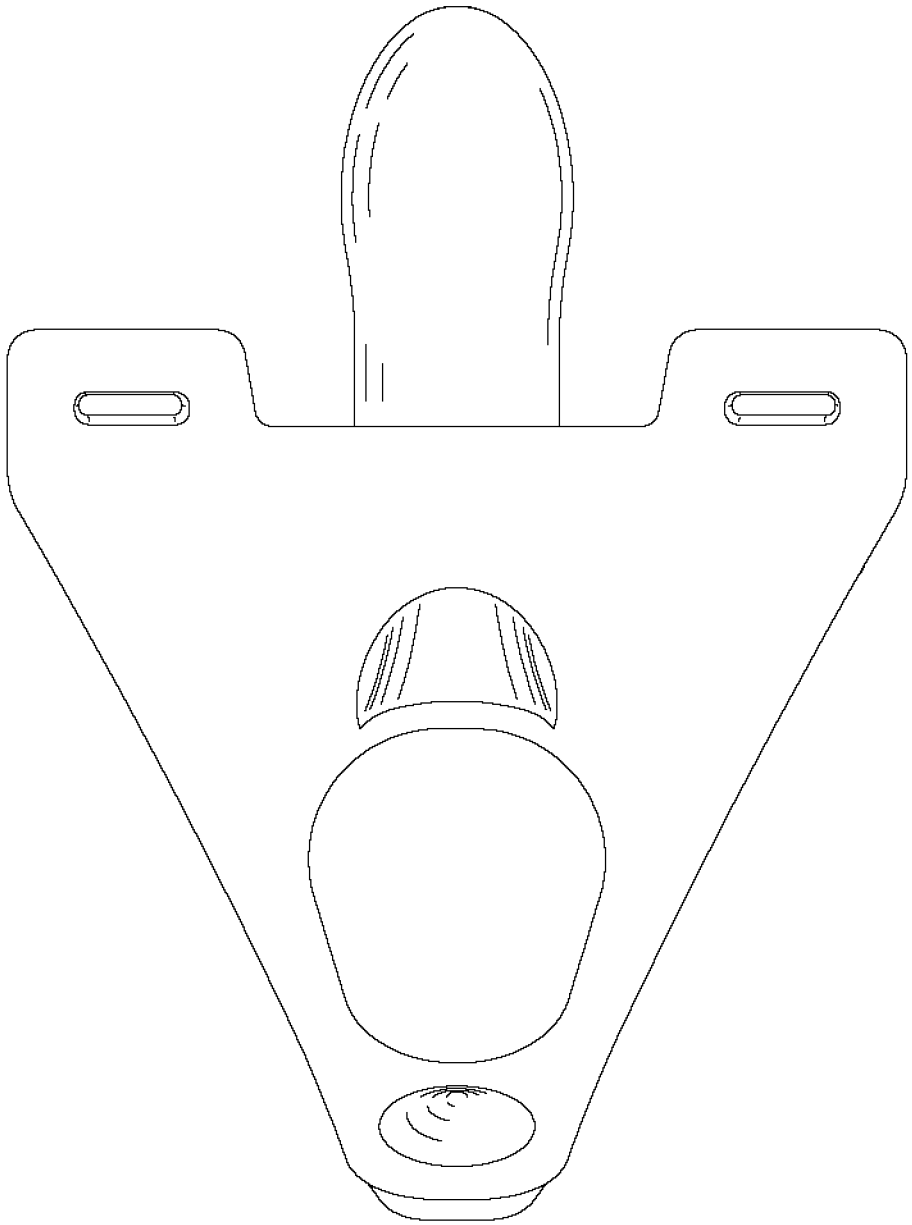
FIG. 2 depicts a rear view of the present invention.

Adverting now to the figures, FIGS. 1 and 2 depict a unitary dildo harness device worn by a user in sexual activity. Harness plate 100 includes an outer surface 102 and inner surface 104. Inner surface 104 of harness plate 100 makes contact with a user wearing the harness plate 100. Outer surface 102, specifically elongated member 106, is positioned to make direct contact with the user receiving the sexual activity.

Harness plate 100, specifically inner surface 104, is contoured to comfortably fit the user's body. As the user can be a male or female, harness plate 100 is contoured to comfortably fit any type of user. A comfortable fit is one where the user does not experience pain or excessive irritation when harness plate 100 is used as directed. Harness plate 100 is shaped to fit around male and female genitalia. The ability for a male and female user to use harness plate 100 allows both sex partners to use harness 100 interchangeably in sexual activity between a male and female.

Outer surface 102 of harness plate 100 includes elongated member 106. Elongated member 106 extends, or protrudes, outward from outer surface 102 at base 108 until tip 110. Elongated member 106, from base 108 to tip 110, forms a phallic shape. The phallic shape of elongated member 106, typically in an erect form, is created in a myriad of shapes and sizes.

Elongated member 106 mimics the phallic nature of a male penis, although numerous additional shapes are used to provide similar sexual stimulation. As the shape and size of a male penis varies greater over the vast population, the shape and size of the elongated member 106 on harness plate 100 also varies to provide different fits to the consumers using the instant invention. The changing features of elongated member 106 includes, but is not limited to, girth, width, length, and tip profile, i.e. circumcised or non-circumcised.

Varying embodiments of elongated member 106 include a textured surface, in addition to a curvilinear profile for elongated member 106. The textured surface includes, but is not limited to, ridges, bumps, and other surface protrusions that enhance sexual activity. Alternate examples of elongated member 106 include the glans region of the penis and foreskin. Depending on the user needs, harness plate 100 comes in a vast variety of colors.

Figure 3:
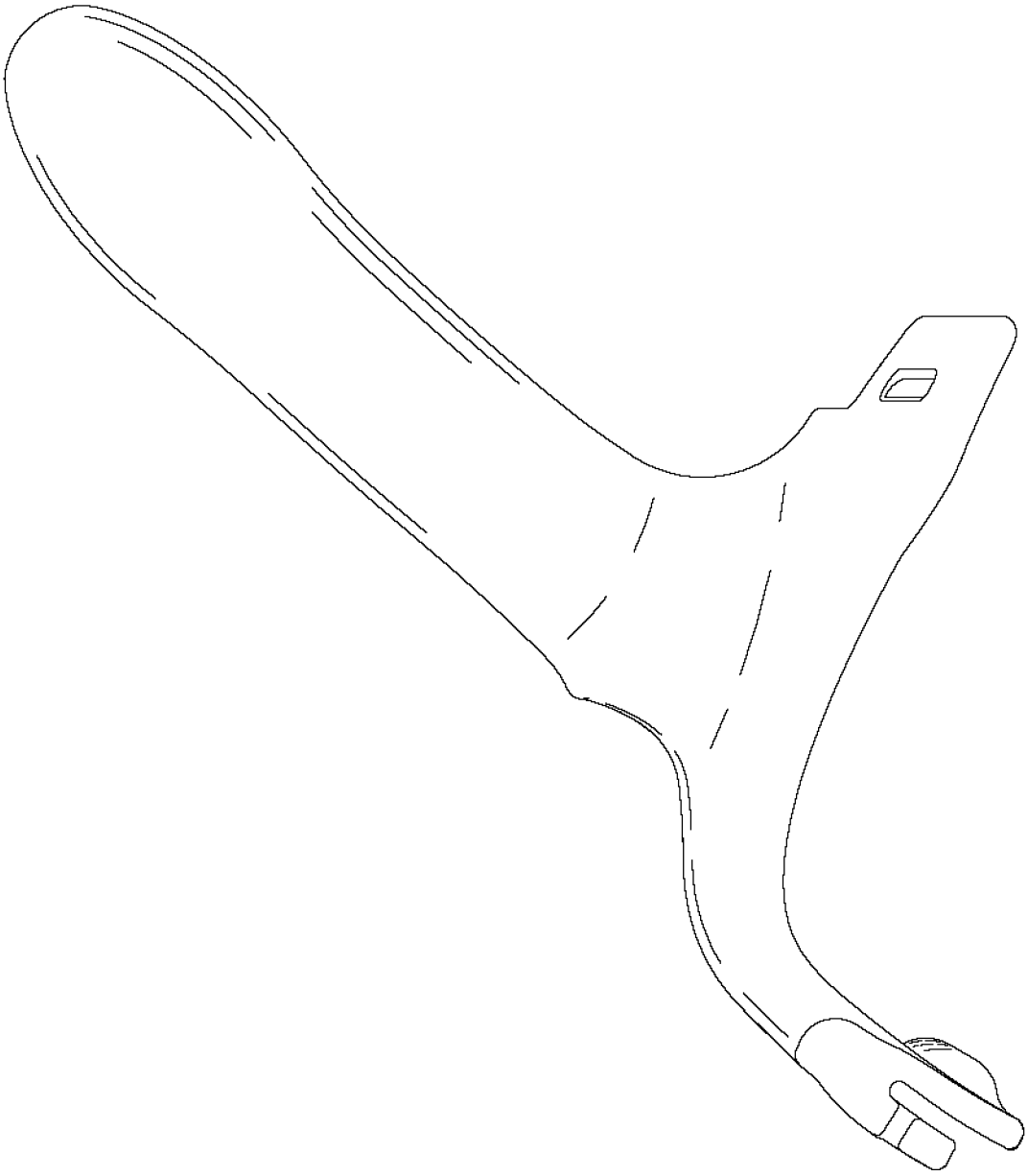
FIG. 3 depicts a side view of the present invention.
Figure 4:
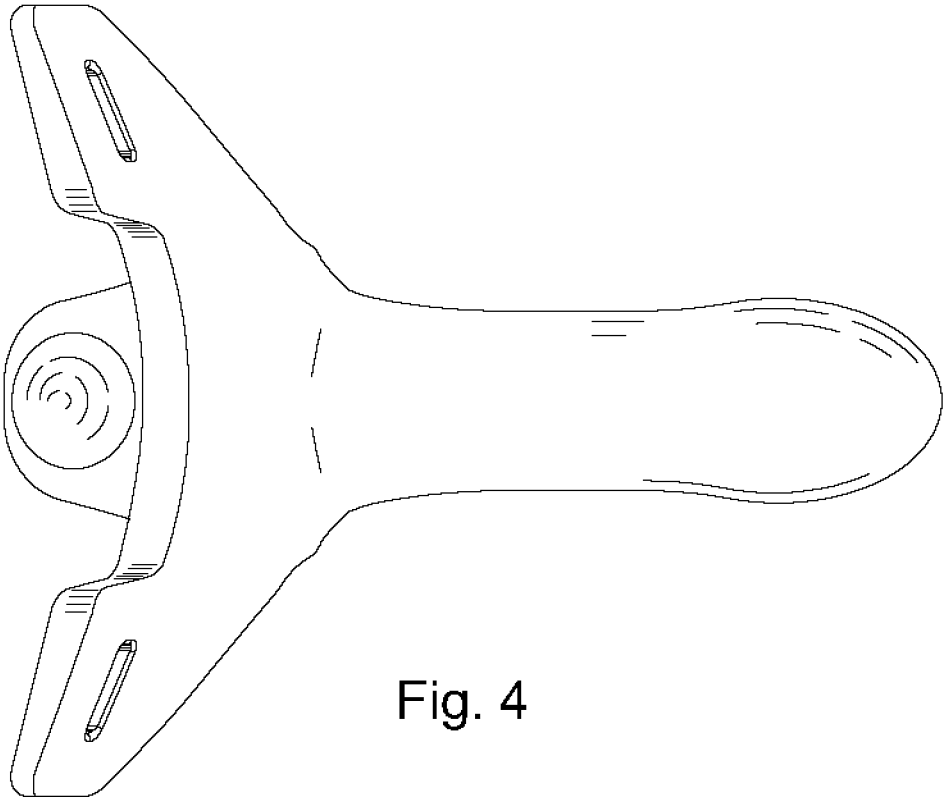
FIG. 4 depicts a top view of the present invention.

As shown in FIGS. 1, 2, and 3, harness plate 100 includes connection mounts for securing the harness plate 100 to a user. The connection mounts are used to secure harness plate 100 to the user. Connection mounts include, but are not limited to, slots, snaps, clips, straps, glues, chemical bonds, hook and loop type fasteners, bolts, screws, other fasteners common in the industry. In an example embodiment, the connection mounts of harness plate 100 are directly integrated to the straps that secure harness plate 100 to the user. Such straps are made of a different material or same material as harness plate 100.

The connection mounts are either permanent connection points or are removable through connections common in the industry. The preferred embodiment of the instant invention, and accompanying figures, illustrate connection mounts as slots that allows straps to secure the harness plate 100 to a user. However, a myriad of permanent connections or removable fasteners may be used to secure harness plate 100 to straps.

FIGS. 1 and 2 show two upper slots 112 near the upward portion of harness plate 100 and one bottom slot 114 near the bottom portion of harness plate 100. Upper slots 112 and bottom slot 114 are used to secure the harness plate 100 to a user or other device. Slots 112 and 114 are shown in FIGS. 1 and 2 as wide openings. The shape of slots 112 and 114 takes many shapes, such as circular and oval, and is not limited to the shapes depicted in the figures.

Harness 100 is secured to a user by attaching a harness strap, not depicted, through slots 112 and 114. Harness straps are looped through upper slots 112 and go around a user's waist area. Another harness strap is looped through bottom slot 114 and travels between a user's legs, near the user's genitalia. The various straps secured through slots 112 and 114 are joined to secure harness plate 100 to the user. FIGS. 1 and 2 depict two upper slots 112 and one bottom slot 114. However, varying embodiments of the number and placement of the slots 112 and 114 alter the securing strength and added stimulation of the harness plate 100 on the user while in use.

For the instant invention, a user is either a male, female, or any variation of thereof. Harness plate 100 is worn by a user while engaged in sexual activity. Sexual activity includes, but is not limited to, the varying forms of anal, vaginal, and oral intercourse or stimulation.

Moreover, harness plate 100 is used by a single user for direct use, two users, or a group of users engaged in sexual activity. A single user uses the harness plate manually. For single user, harness plate 100 is manually operated by the user or by attaching the harness plate to another object to allow the single user to engage in sexual activity with the harness plate 100.

Figure 5:
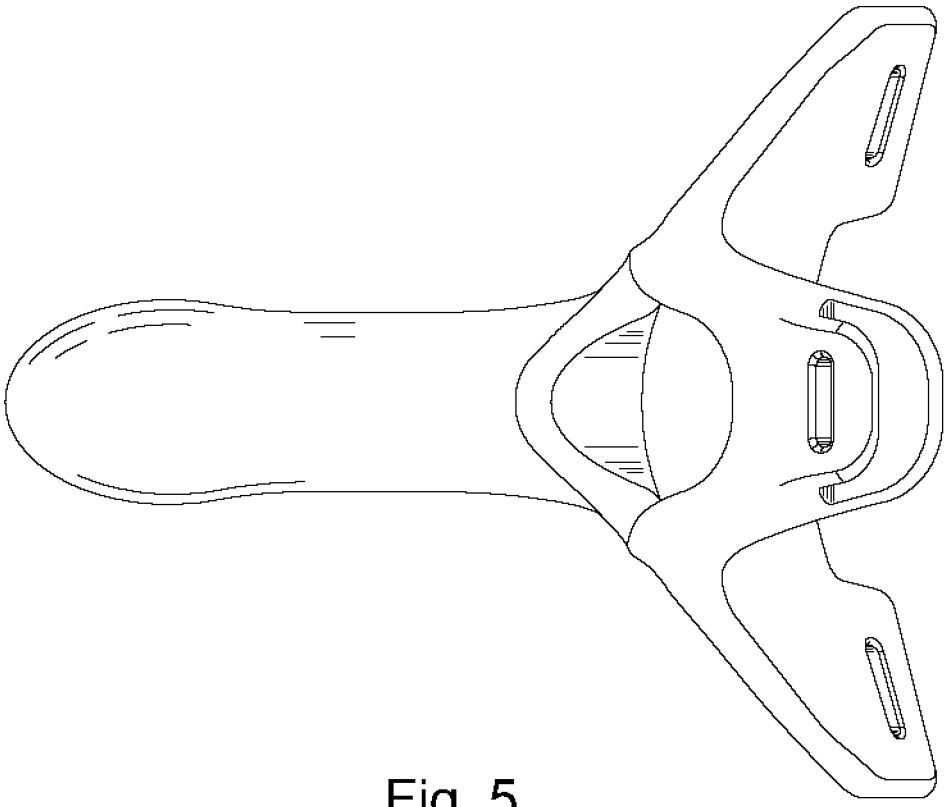
FIG. 5 depicts a bottom view of the present invention.
Figure 7:
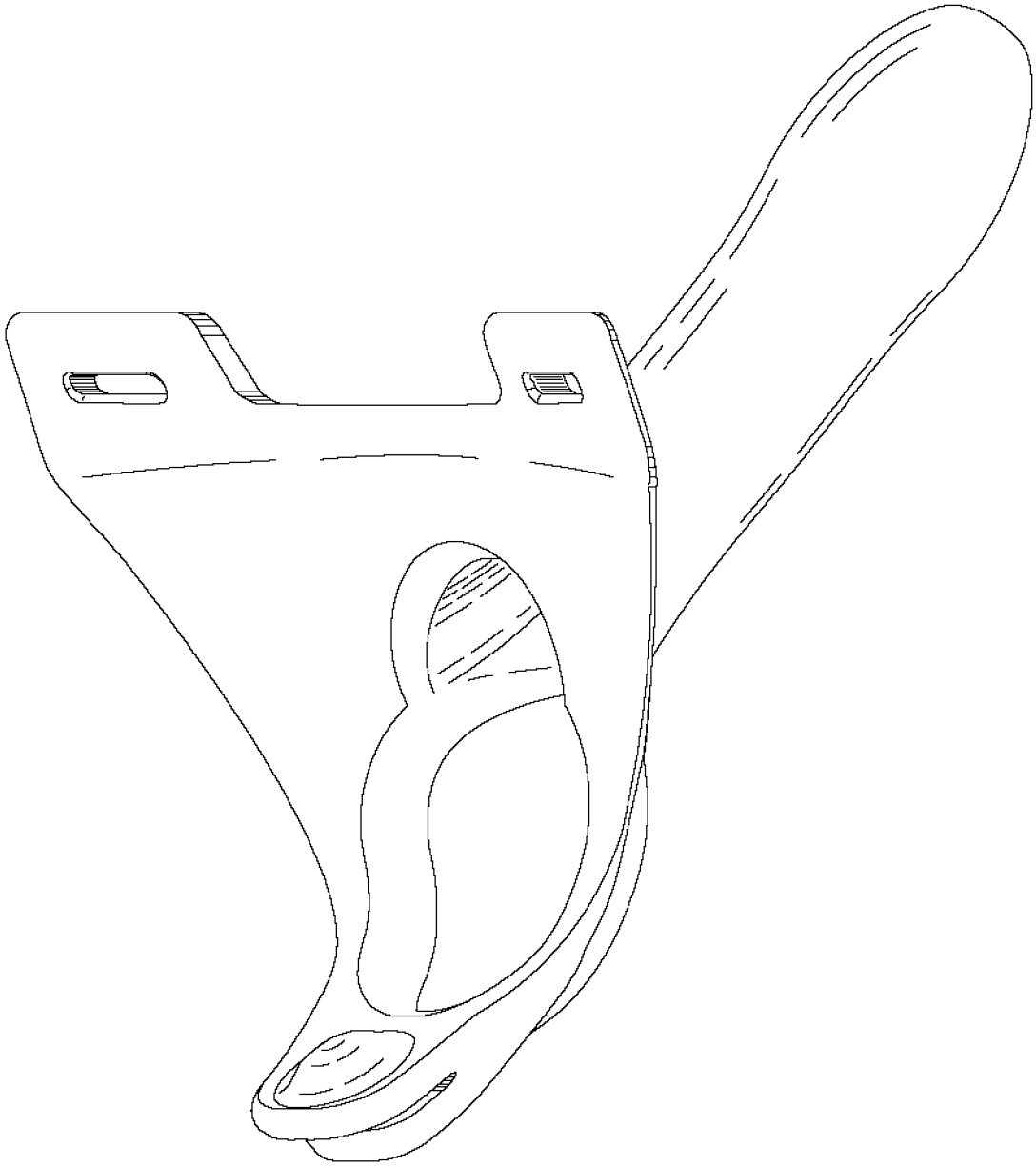
FIG. 7 depicts a rear perspective view of the present invention.

In an exemplary embodiment of the unitary dildo harness device, elongated member 106 includes cavity 202, as shown in FIGS. 2, 5, and 7. Cavity 202 is enclosed by outer surface 102 that defines elongated member 106. Access to cavity 202 occurs through inner surface 104. Cavity 202 is designed to provide a space inside of elongated member 106 for the insertion of a user's penis. A user inserts his penis into cavity 202 from the inner surface 104 side while securing harness plate 100 onto his body. The user then engages in sexual activity by using elongated member 106 of harness plate 100 in a similar fashion as a penis or other phallic device. Although cavity 202 is designed to allow for the insertion of a user's penis, a penis is not required to use harness plate 100, even when cavity 202 is present. Harness 100, with or without cavity 202, is configured for a user to wear without a penis.

Figure 6:
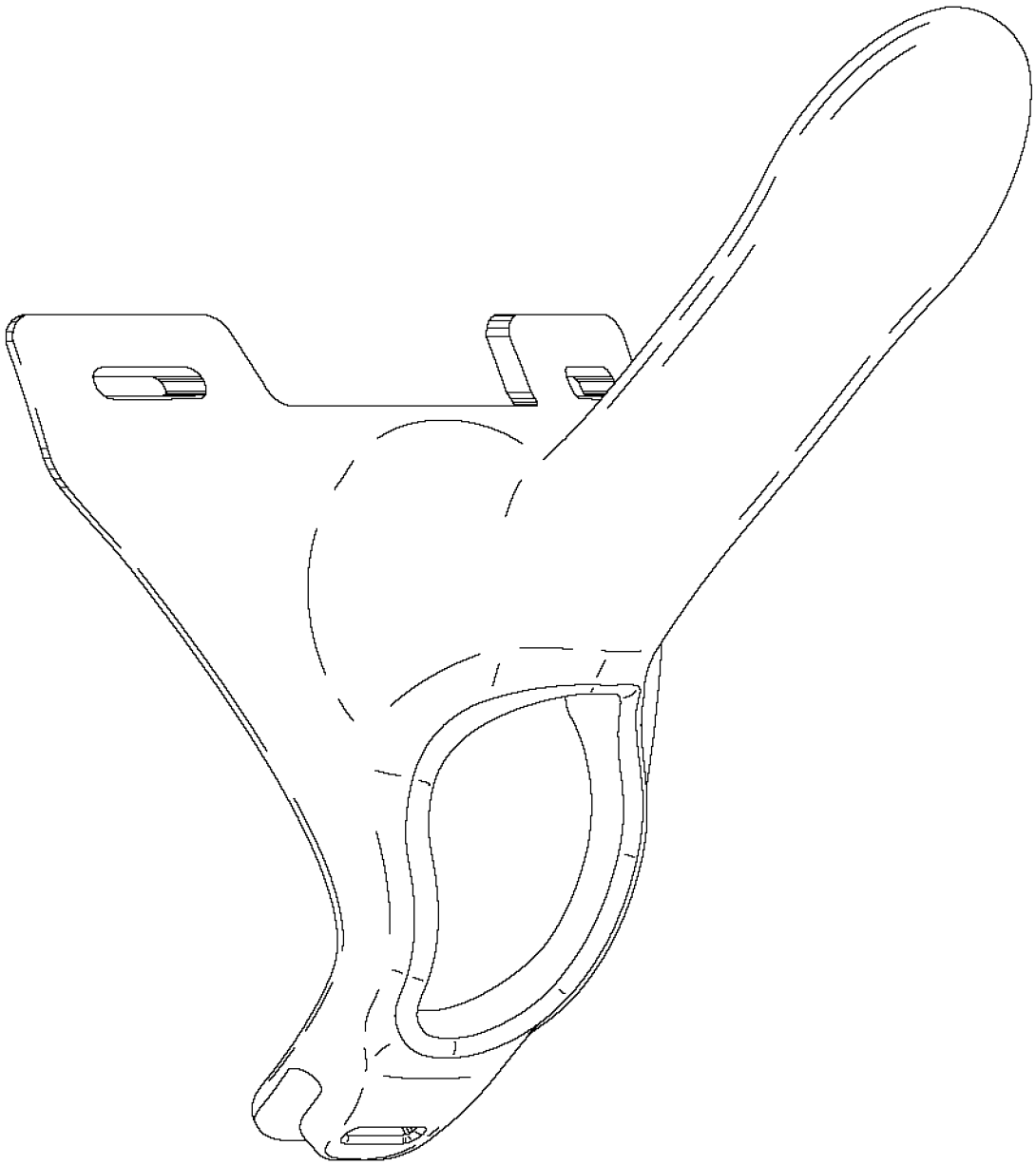
FIG. 6 depicts a front perspective view of the present invention.

Another exemplary embodiment of the unitary dildo harness device includes opening 116 in harness plate 100 that leaves a space on both outer surface 102 and inner surface 104, as shown in FIGS. 1, 2, and 6. Opening 116 is preferably positioned on harness plate 100 underneath elongated member 106.

For a user with male genitalia, such as a penis and testicles, the penis is inserted into cavity 202 inside elongated member 106 and the testicles pass through opening 116. Without opening 116, a user's testicles would be pressed against inner surface 104 of harness plate 100 when harness plate 100 is secured to the user. During thrusts of sexual activity, the force against the user's testicles would cause great discomfort to the user's testicles since they are a sensitive part of the human body. Furthermore, the male genitalia may also be used such that it is not inserted into cavity 202 but rather tucked down with the testicles through opening 116. This allows a user with a large flaccid penis to still wear the device, or the use of adding a vibrator to the inside of the cavity in lieu of the penis.

For a user with female genitalia, such as a vagina, harness plate 100, with or without cavity 202, is secured to the user. A user's vagina is accessible through opening 116 of harness plate 100. Opening 116 for a user with female genitalia provides two important benefits. First, harness plate 100 is not directly pressing on the female genitalia, which is also a sensitive area of the human body. Secondly, opening 116 provides access to a user's female genitalia through harness plate 100 during sexual activity. Without opening 116, harness plate 100 will block access to a female user's genitalia, thereby limiting the scope of sexual activity.

As shown in FIGS. 1, 2, and 6, opening 116 follows the overall contour of harness plate 100. As the shape of harness plate 100 contours to the shape of the user's body, opening 116 follows the same contour. In the preferred embodiment, upper slots 112 are located near the pelvic region of the human body, where the abdomen and thighs meet. Harness plate 100 contours to the user's body, such that bottom slot 114 is located between a user's legs, near the anus and perineum. The contoured shape of harness plate 100 and opening 116 allows a user with male or female genitalia to wear harness plate 100 comfortably.

In an exemplary embodiment of the instant invention, the border of harness plate 100 that defines opening 116 includes opening edge 206. Opening edge 206 provides a chamfered edge to reduce or eliminate any sharp or jagged edges from touching the user. When harness plate 100 is secured on a user, sharp or jagged edges will cause discomfort or injury. Opening edge 206 is chamfered to create a smooth edge on harness plate 100 to minimize any discomfort to the user. In yet another exemplary embodiment of the instant invention, shown in FIG. 6, harness plate edge 208 of harness plate 100 is a chamfered, similarly to opening edge 206, to provide a smooth surface while worn on the user.

Another feature of the instant invention is nodule 204 on harness plate 100. Nodule 204 is located on the lower portion of the inner surface 104 of harness place 100. Nodule 204 protrudes outward from inner surface 104. As illustrated in FIGS. 2, 3, 4, and 7, the preferred shape of nodule 204 is a partial spherical shape.

When secured to a user, nodule 204 on harness plate 100 exerts pressure on a user's perineum. For a male, the perineum is the area of the body between the scrotum/penis and anus. For a female, the perineum is the area of the body between the vagina and the anus. The perineum is an erogenous zone on the human body for both males and females. Notably, the perineum has a high concentration of nerve endings that provide additional stimulation during sexual activity.

The placement of nodule 204 on the inner surface 104 of harness plate 100 is aligned to touch the user's perineum. When harness plate 100 is secured to the user, nodule 204 contacts the perineum, which causes static stimulation. While harness plate 100 is used during sexual activity, nodule 204 exerts varying force on the perineum that corresponds to the motion involved in the sexual activity. For instance, when a user wearing harness plate 100 thrusts their body back and forth, as is typical during sexual intercourse, the force exerted by nodule 204 on the user's perineum varies. This creates a pleasurable stimulation on the user's perineum, an erogenous zone on the body.

In yet another exemplary embodiment, illustrated in FIG. 3, harness plate 100 includes notch 302. Notch 302 is the opening of harness plate 100 between outer sleeve 304 and inner sleeve 306. In this embodiment, bottom slot 114 is positioned on outer sleeve 304 of harness plate 100. The spacing of notch 302 allows the harness strapping, banding, or other connection mechanism for securing harness plate 100 to the user, to travel through bottom slot 114.

The positioning of bottom slot 114 on outer sleeve 304, in relation to inner sleeve 306, provides the user increased stimulation or pleasure while using the instant invention. In an example embodiment, pictured in FIG. 3, inner sleeve 306 extends past outer sleeve 304. When the strapping used to secure harness plate 100 to the user is routed through bottom slot 114, the strapping presses against inner sleeve 306.

The elasticity of harness plate 100 allows inner sleeve 306 to flex inward as the strapping presses against inner sleeve 306. Since nodule 204 is located on the inner surface 104 of inner sleeve 306, movement of inner sleeve 306 causes movement of nodule 204. Nodule 204 is positioned to exert force on the user's perineum. When harness 100 is secured to a user, the strapping routed through bottom slot 114 exerts force on inner sleeve 306, which causes nodule 204 to exert force on the user's perineum. As harness plate 100 is used during sexual activity, such as intercourse, the varying and rhythmic thrusts by the user cause nodule 204 to exert varying force on the user's perineum, thereby providing additional stimulation to the user.

The inclusion of nodule 204 on harness plate 100 creates added stimulation to the user during sexual activity that present harnesses do not provide. Moreover, the placement of the strapping through bottom slot 114 provides a direct correlation between the movement of the user wearing harness plate 100 the force exerted onto the user's perineum by nodule 204. Varying the thrust force, rhythm, depth, and other sexual movements of harness plate 100 creates a wide ranging and constantly changing interaction between nodule 204 and a user's perineum.

Another benefit created by notch 302 is the ability of the harness strapping to make contact with inner sleeve 306 and not the user's direct skin. Direct contact between the strapping used to secure harness plate 100 to the user and a user's skin will cause chafing, especially given the sensitive nature of skin in the genital region. By using inner sleeve 306 as a contact point for strapping, the orientation of inner sleeve 306 creates added stimulation through nodule 204 and reduces chafing by the strapping on the user's direct skin.

The unitary design of harness plate 100 provides a hygienic sexual device that is superior over current technology that has at least one connection that requires cleaning to prevent unwanted debris and bacteria from accumulating. As elongated member 106 protrudes from the outer surface 102 of harness plate 100, mimicking the phallic shape of a male penis, there are no connections on the instant invention. As a unitary piece, bacteria and debris cannot collect on any connection crevasses since there are no connections in harness plate 100.

Having thus described preferred embodiments, it should be apparent to those skilled in the art that certain advantages of the described system have been achieved. It should also be appreciated that various modifications, adaptions, and alternative embodiments thereof may be made within the scope and spirit of the present invention. The invention is further defined by the following claims.

What I claim is:

1. A device, comprising:

a contoured member adapted to be disposed at a pubic region and a perineum of a donning user, said contoured member having:

an outer surface and an inner surface;

at least one elongated member with a base and a tip, said base extending outward from said contoured member;

at least one upper connection mount and at least one bottom connection mount adapted to secure said contoured member to the donning user;

the at least one bottom connection mount disposed at the contoured member where the contoured member is adapted to contact the perineum of the donning user; and, the at least one upper connection mount adapted to be disposed at the contoured member between the elongated member and an edge of the contoured member adapted to be disposed at the pubic region of the donning user.

2. The device of claim 1 further comprising:

an opening in the contoured member disposed at the base of the elongated member.

3. The device of claim 2 wherein said opening extends between the base of the elongated member and where the contoured member is disposed to contact the perineum of the donning user.

4. The device of claim 3 wherein said opening extends into the base of the elongated member.

5. The device of claim 3 wherein said opening further extends between the base of the elongated member and where the contoured member is disposed to contact the perineum of the donning user.

6. The device of claim 5 wherein said opening is adapted to be disposed at the vagina of the donning user.

7. The device of claim 5 wherein the inner surface and outer surface contiguously surround the contoured member so that so that the contoured member constitutes a single unified dildo and harness plate.

8. The device of claim 5 wherein the inner surface and outer surface comprise a silicone blend.

9. The device of claim 3 wherein said opening is adapted to be disposed at the scrotum of the donning user.

10. The device of claim 9 wherein the elongated member is hollow.

11. The device of claim 2 wherein harness straps are integrated into at least one said upper connection mount.

12. The device of claim 2 wherein harness straps are detachably connected to at least one said upper connection mount.

13. The device of claim 12 wherein the harness straps are detachably connected to more than one upper connection mount.

14. The device of claim 13 wherein the harness straps are also connected to at least one said bottom connection mount.

15. The device of claim 2 wherein harness straps are connected to at least one said bottom connection mount.

16. The device of claim 15 wherein the bottom connection mount further comprises a slot.

17. The device of claim 1 wherein one or more harness straps are connected to at least one said upper connection mount.

18. A device, comprising:

a contoured member adapted to be disposed at a pubic region and a perineum of a donning user, said contoured member having:

an outer surface and an inner surface comprising silicone;

at least one elongated member with a base and a tip, said base extending outward from said contoured member;

at least one upper connection mount and at least one bottom connection mount adapted to secure said contoured member to the donning user;

the at least one bottom connection mount disposed at the contoured member where the contoured member is adapted to contact the perineum of the donning user;

the at least one upper connection mount adapted to be disposed at the contoured member between the elongated member and an edge of the contoured member adapted to be disposed at the pubic region of the donning user;

an opening in the contoured member disposed at the base of the elongated member that is adapted to enable access to the genitalia of the donning user while the device is donned.

19. The device of claim 18 further comprising harness straps integrated into the at least one upper connection mount.

20. The device of claim 18 further comprising harness straps detachably connected to at least one of the at least one upper connection mount or the at least one bottom connection mount.

* * * * *